US008454302B2

(12) United States Patent
Wieghardt

(10) Patent No.: US 8,454,302 B2
(45) Date of Patent: Jun. 4, 2013

(54) STEAM FEED FOR A STEAM TURBINE

(75) Inventor: Kai Wieghardt, Mannheim (DE)

(73) Assignee: Siemens Aktiengesellschaft, München (DE)

( * ) Notice: Subject to any disclaimer, the term of this patent is extended or adjusted under 35 U.S.C. 154(b) by 672 days.

(21) Appl. No.: 12/672,134

(22) PCT Filed: Jul. 25, 2008

(86) PCT No.: PCT/EP2008/059811
§ 371 (c)(1),
(2), (4) Date: Feb. 4, 2010

(87) PCT Pub. No.: WO2009/019151
PCT Pub. Date: Feb. 12, 2009

(65) Prior Publication Data

US 2011/0226376 A1 Sep. 22, 2011

(30) Foreign Application Priority Data

Aug. 8, 2007 (EP) ..... 07015628

(51) Int. Cl.
*F01D 1/00* (2006.01)

(52) U.S. Cl.
USPC ..... 415/117; 415/182.1; 416/95

(58) Field of Classification Search
USPC ..... 415/108, 182.1, 183, 184, 185, 189, 415/202, 117
See application file for complete search history.

(56) References Cited

U.S. PATENT DOCUMENTS 2,800,299 A 7/1957 Sheppard et al.
4,642,025 A * 2/1987 Heiniger et al. ..... 415/139

FOREIGN PATENT DOCUMENTS

| | | | |
|---|---|---|---|
| EP | 0128343 | A1 | 12/1984 |
| GB | 825849 | A | 12/1959 |
| GB | 1135767 | A | 12/1968 |
| JP | 3062882 | A | 3/1991 |

* cited by examiner

*Primary Examiner* — Edward Look
*Assistant Examiner* — Maxime Adjagbe

(57) ABSTRACT

A steam supply for a turbomachine with an inner housing and an outer housing is provided. The steam supply includes an inner pipe and an outer pipe, a cooling medium inlet opening disposed in the outer pipe and a cooling medium entering thereby into space between the inner pipe and the outer pipe, and the inner pipe being cooled thereby.

13 Claims, 2 Drawing Sheets

STEAM FEED FOR A STEAM TURBINE

CROSS REFERENCE TO RELATED APPLICATIONS

This application is the US National Stage of International Application No. PCT/EP2008/059811 filed Jul. 25, 2008, and claims the benefit thereof. The International Application claims the benefits of European Application No. 07015628.6 EP filed Aug. 8, 2007. All of the applications are incorporated by reference herein in their entirety.

FIELD OF INVENTION

The invention refers to a steam feed for a turbomachine, especially a steam turbine, comprising an inner casing and an outer casing, which steam feed comprises: a first inner pipe for the guiding of flow medium, wherein the inner pipe is designed for abutting onto an inner-casing admission opening of the inner casing, and an outer pipe which is arranged around the inner pipe, wherein the steam feed is designed for abutting onto an outer-casing admission opening of the turbomachine.

SUMMARY OF INVENTION

Turbomachines, such as steam turbines, are operated with a flow medium. In steam turbines, steam is used as flow medium which can have a temperature of over 600° C. at a pressure of over 300 bar. Such high temperatures and pressures make increased demands upon the materials of the steam turbine. In particular, the region of the steam admission is thermally and mechanically highly stressed.

A steam turbine as an embodiment of a turbomachine, for using intensely heated live steam which flows into the steam turbine, customarily has an inner casing, an outer casing which is arranged around the inner casing, and a rotor which is rotatably mounted inside the inner casing. The live steam flows in via so-called admission connectors, through the outer casing and the inner casing, into the flow passage. The region around these admission connectors is therefore thermally highly stressed. By means of suitable steam feed lines the hot steam is thermally decoupled from the outer casing as far as possible.

It is an object of the invention to disclose a steam feed which is suitable for high temperatures.

This object is achieved by a steam feed as claimed in the independent claim. Further advantageous developments are disclosed in the dependent claims.

The invention starts inter alia from the aspect that it is advantageous if a steam feed has two pipes which are arranged coaxially one over the other, wherein the live steam flows through the inner pipe and a cooling medium flows around the inner pipe.

The invention offers inter alia the advantage that the steam feed line is formed in such a way that an outer pipe is arranged around an inner pipe. A gap in which a cooling medium can flow is formed between the outer pipe and the inner pipe. This cooling medium effects cooling of the outer pipe. The outer pipe can now be coupled directly to a steam turbine, wherein the steam turbine is less thermally stressed. Therefore, live steam at high temperature can be used.

The cooling medium is admitted via a cooling-medium inflow opening into the space between the outer pipe and the inner pipe. The cooling medium in this case can be an external cooling medium or can originate from the steam turbine. The steam which discharges downstream of the flow passage for example can be used as cooling medium. In known steam turbines, live steam at a temperature of about 620° C. and a pressure of about 350 bar is admitted into the steam turbine and is expanded in the flow passage, wherein the thermal energy of the steam is converted into mechanical energy and induces a rotation of the rotor. Downstream of the flow passage, the expanded steam can have a temperature of 500° C. and can be used as cooling medium.

The expanded steam is customarily brought to a pressure of about 350 bar in a reheater and is referred to as reheated steam. This reheated steam can also be used as cooling medium.

The cooling medium which is around the inner pipe acts in the radial direction and therefore exerts a mechanical stress upon the inner pipe and upon the outer pipe. The inner pipe and the outer pipe are consequently mechanically unloaded.

In an advantageous development, the outer pipe and the inner pipe are interconnected at a first point, wherein a mechanically tightly seating connection is to be understood by this. This connection for example can be achieved by means of connecting means such as screwing or similar. It would be a further possibility to connect the outer pipe to the inner pipe at a first point if the outer pipe and the inner pipe were formed materially in one piece. As a result of this arrangement at the first point, escape of the cooling medium from the space between the outer pipe and the inner pipe is prevented.

In a further advantageous development, the outer pipe is connected to the inner pipe at a second point. As a result of this measure, escape of the cooling medium from the space between the outer pipe and the inner pipe is prevented.

An inflow opening is advantageously arranged between the first and second points. Consequently, a simple possibility is provided of filling the cooling medium in the space between the outer pipe and the inner pipe.

BRIEF DESCRIPTION OF THE DRAWINGS

Further developments and advantages of the invention result from the subsequent description section in which an exemplary embodiment of the invention is explained in more detail with reference to a drawing.

In the drawing.

DETAILED DESCRIPTION OF INVENTION

Figure 1:
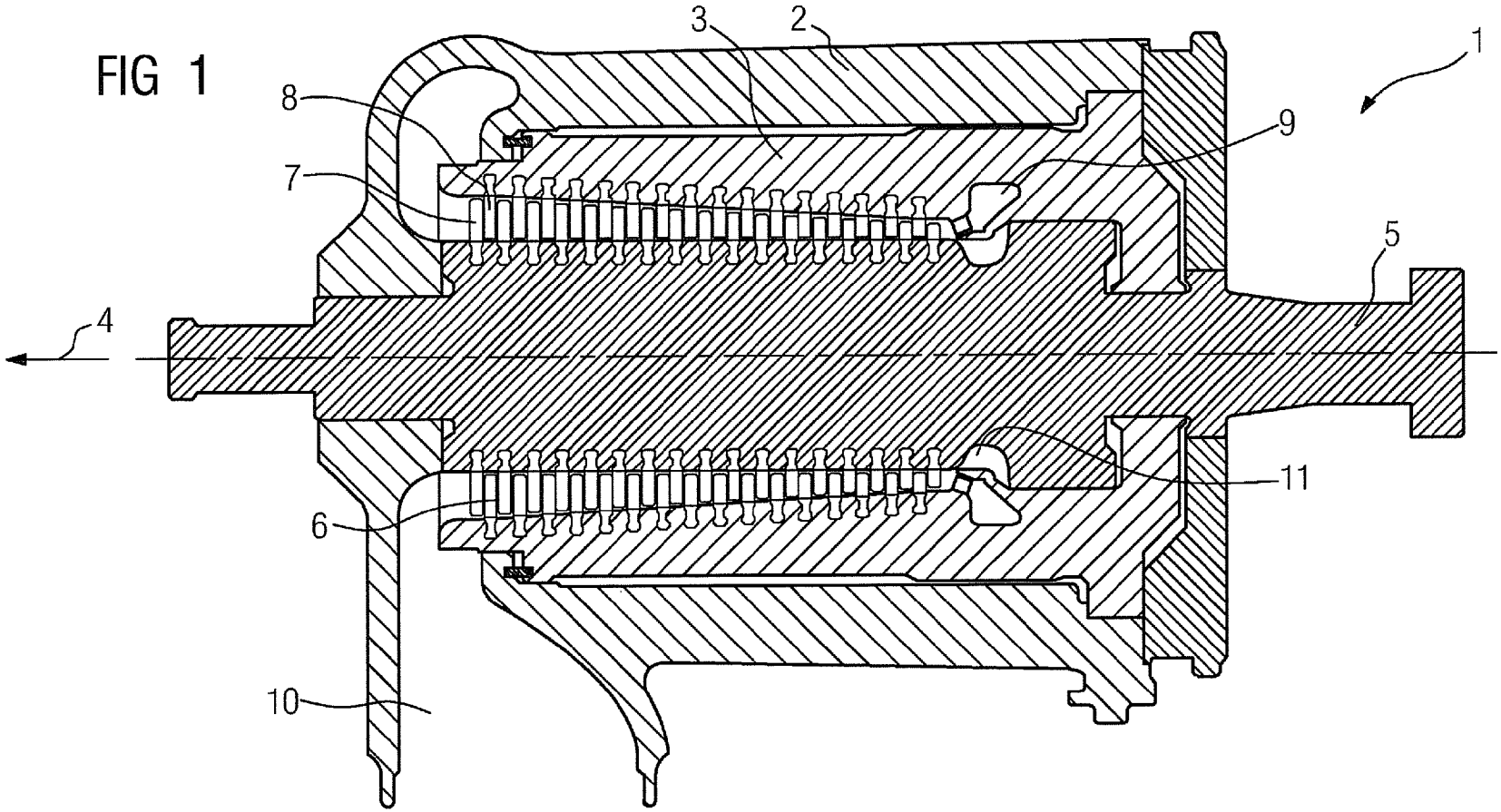
FIG. 1 shows a cross-sectional view of a steam turbine.

In FIG. 1, a cross-sectional view of a steam turbine 1 as an embodiment of a turbomachine is shown. The steam turbine 1 comprises an outer casing 2 and an inner casing 3. The inner casing 3 is arranged inside the outer casing 2. The inner casing 3 and the outer casing 2 are essentially symmetrically formed around a rotational axis 4. Inside the inner casing 3, a shaft 5 is rotatably mounted around the rotational axis 4. A flow passage 6 is formed between the shaft 5 and the inner casing 3. The flow passage 6 is characterized by rotor blades 7 which are arranged on the shaft 5 and stator blades 8 which are arranged in the inner casing 3. For the sake of clarity, only one stator blade and one rotor blade are identified in FIG. 1 by the designation 8 or 7.

During operation, live steam flows into the steam turbine 1 via an admission passage 9. The live steam then flows into the flow passage 6, past the stator blades and rotor blades 8, 7, expands and cools down in the process. In so doing, the thermal energy of the steam is converted into rotational energy of the shaft 5. The expanded steam then flows out of the steam turbine 1 via an exhaust gas connector 10.

Figure 2:
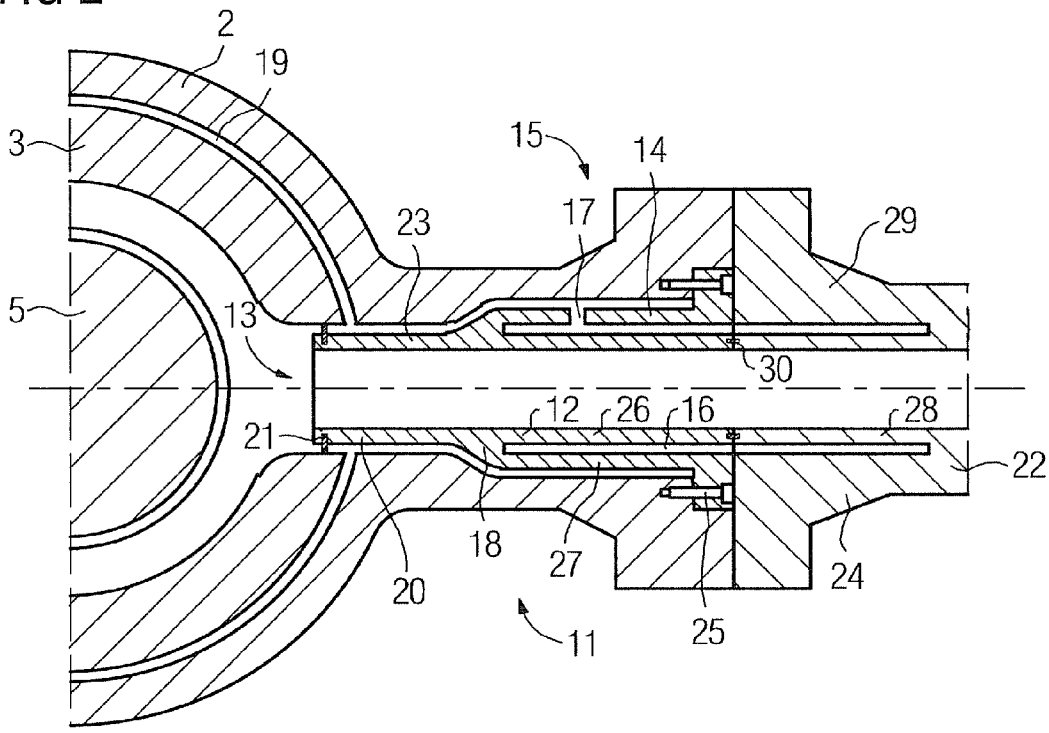
FIG. 2 shows a partial cross-sectional view of a steam turbine in the axial direction.

In modern steam turbines, the live steam has temperatures of over 600° C. and a pressure of over 300 bar. As shown in FIG. 2, the live steam is directed into the steam turbine 1 via a live steam feed 11. FIG. 2 shows a cross-sectional view, wherein this cross-sectional view is shown in the axial direction. The steam feed 11 comprises a first inner pipe 12 for the guiding of a flow medium, such as the live steam. The inner pipe 12 is designed for abutting onto an inner-casing admission opening 13 of the inner casing 3. Furthermore, the steam feed 11 has an outer pipe 14 which is arranged around the inner pipe 12. The steam feed 11 is designed for abutting onto an outer-casing admission opening 15. A cooling medium is fed into the space 16 between the inner pipe 12 and the outer pipe 14. The cooling medium primarily cools the outer pipe 14. The cooling medium flows into the space 16 via a cooling-medium inflow opening 17. The inner pipe 12 and the outer pipe 14 are interconnected at a first point 18, i.e. so that the cooling medium in the space 16 cannot flow into the space 19 between the inner casing 3 and the outer casing 2. The steam feed 11 is attached by one end 20, via seals 21, to the inner casing 3 with sealing effect. The cooling-medium inflow opening 17 is arranged between the first point 18 and a second point 22. The steam feed 11 can be constructed from essentially two components, wherein the steam feed 11 is formed from a first component 23 and a second component 24. The first component 23 can be attached via a screwed connection 25 to the outer casing 2. The second component 24 can be connected to the first component 23 also via screwed connections or similar fastening means. The fastening means are not shown in more detail in FIG. 2. A screw may serve as an example of a fastening means.

The first component 23 comprises a first inner pipe 26. Furthermore, the first component 23 has a first outer pipe 27. The second component 24 has a second inner pipe 28 and a second outer pipe 29. An I-ring seal 30 can be arranged between the first inner pipe 26 and the second inner pipe 28. Such an I-ring seal 30 can also be arranged between the first outer pipe 27 and the second outer pipe 29.

The inner pipe 12 and the outer pipe 14 are formed materially in one piece. For example, the same material can be used which is also used for the inner casing 3. As is to be seen in FIG. 2, a common space is formed between the first inner pipe 26 and the first outer pipe 27 and also between the second inner pipe 28 and the second outer pipe 29.

Figure 3:
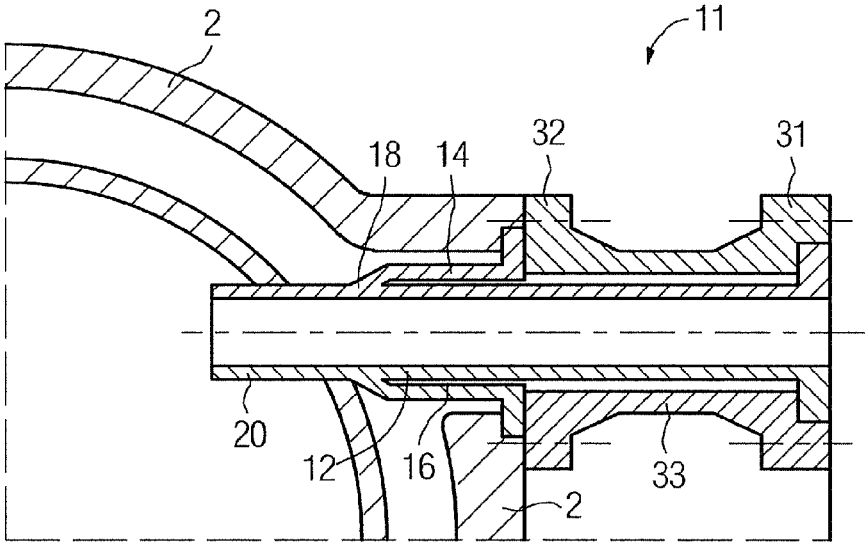
FIG. 3 shows an alternative embodiment of a steam feed in cross-sectional view.

In FIG. 3, an alternative embodiment of the steam feed 11 is shown. The steam feed 11 according to FIG. 3 is arranged in such a way that the outer pipe 14 is attached on the outer casing 2 by means of fastening means, which are not shown in more detail. The steam feed 11 also has an inner pipe 12 which is arranged inside the outer pipe 14. A space 16 is also formed between the inner pipe 12 and the outer pipe 14. The outer pipe 14 is fastened to the outer casing 2 at the first fastening point 32. The inner pipe 12 is connected to an additional pipe 33 at a second fastening point 31. The additional pipe 33 can consist of the same material as the outer casing 2. Via fastening means, which are not shown in more detail, the additional pipe 33 is connected to the outer casing 2 at the first fastening point 32. A further external pipe is connected to the additional pipe 33 at the second fastening point 31. In the embodiment of the steam feed 11 according to FIG. 3, the feed of cooling medium can be carried out either in the additional pipe 33 or through a cooling-medium inflow opening in the outer pipe 14, wherein the two feed openings are not shown in more detail in FIG. 3. The outer pipe 14 is constructed as a so-called thermo-sleeve, i.e. so that the outer pipe 14 absorbs an axial temperature gradient.

An increase of the throughput of cooling medium in the space 16 is maintained by a plurality of cooling-medium inflow openings 17 being arranged in the outer pipe 14. The outer pipe 14 is perforated, so to speak.

The invention claimed is:

1. A steam feed for a turbomachine including an inner casing and an outer casing, comprising:
- an inner pipe for guiding a flow medium;
- an outer pipe arranged around the inner pipe;
- a first component, comprising:
  - a first inner pipe for guiding a flow medium, wherein the inner pipe is designed for connecting to an inner-casing opening of the inner casing,
  - a first outer pipe arranged around the first inner pipe, wherein the steam feed is designed for connecting to an outer-casing opening of the turbomachine,
  - wherein a cooling-medium inflow opening is provided between the first inner pipe and the first outer pipe for feeding cooling medium;
- a second component, comprising:
  - a second inner pipe, and
  - a second outer pipe,
- wherein the outer pipe of the steam feed is formed from the first outer pipe and the second outer pipe, and wherein the inner pipe of the steam feed is formed from the first inner pipe and the second inner pipe.

2. The steam feed as claimed in claim 1, wherein the outer pipe is connected to the inner pipe at a first point.

3. The steam feed as claimed in claim 1, wherein the outer pipe is connected to the inner pipe at a second point.

4. The steam feed as claimed in claim 2, wherein the outer pipe is connected to the inner pipe at a second point.

5. The steam feed as claimed in claim 3, wherein the cooling-medium inflow opening is arranged between the first and the second point.

6. The steam feed as claimed in claim 4, wherein the cooling-medium inflow opening is arranged between the first and the second point.

7. The steam feed as claimed in claim 1, wherein the outer pipe has fastening means for the fastening onto the outer casing.

8. The steam feed as claimed in claim 7, wherein the fastening means comprises a screw.

9. The steam feed as claimed in claim 1, wherein an I-ring seal is arranged between the first outer pipe and the second outer pipe.

10. The steam feed as claimed in claim 1, wherein an I-ring seal is arranged between the first inner pipe and the second inner pipe.

11. The steam feed as claimed in claim 2, wherein the inner pipe and the outer pipe are formed materially in one piece.

12. The steam feed as claimed in claim 3, wherein the inner pipe and the outer pipe are formed materially in one piece.

13. The steam feed as claimed in claim 4, wherein the inner pipe and the outer pipe are formed materially in one piece.

* * * * *